US006666660B2

(12) United States Patent
Kegg et al.

(10) Patent No.: US 6,666,660 B2
(45) Date of Patent: Dec. 23, 2003

(54) MOTOR-FAN ASSEMBLY FOR A FLOOR CLEANING MACHINE

(75) Inventors: Steven W. Kegg, North Canton, OH (US); James R. Nero, Louisville, OH (US)

(73) Assignee: The Hoover Company, North Canton, OH (US)

( * ) Notice: Subject to any disclaimer, the term of this patent is extended or adjusted under 35 U.S.C. 154(b) by 76 days.

(21) Appl. No.: 09/844,009

(22) Filed: Apr. 27, 2001

(65) Prior Publication Data

US 2002/0159897 A1 Oct. 31, 2002

(51) Int. Cl.[7] ..... F04B 39/06

(52) U.S. Cl. ..... 417/368; 417/423.14; 15/326; 416/183; 416/185

(58) Field of Search ..... 417/368, 423.14, 417/312; 416/183, 185, 223 B, 203, 175; 15/326, 412, 413

(56) References Cited

U.S. PATENT DOCUMENTS

| | | | | | |
|---|---|---|---|---|---|
| 3,932,070 | A | * | 1/1976 | Porter et al. | 417/368 |
| 4,065,233 | A | * | 12/1977 | Torigoe et al. | 417/368 |
| 4,226,575 | A | | 10/1980 | Hyatt et al. | |
| 4,586,214 | A | * | 5/1986 | Berfield | 15/413 |
| 4,621,991 | A | | 11/1986 | Smith et al. | |
| 4,669,952 | A | | 6/1987 | Forsyth, III et al. | |
| 4,824,333 | A | | 4/1989 | Erickson, Jr. | |
| 4,904,158 | A | * | 2/1990 | Kun | 416/183 |
| 5,040,943 | A | | 8/1991 | Dwyer et al. | |
| 5,296,769 | A | | 3/1994 | Havens et al. | 417/423.14 |
| 5,352,099 | A | | 10/1994 | Anstine et al. | |
| 5,365,633 | A | | 11/1994 | Sunagawa et al. | |
| 5,482,378 | A | | 1/1996 | Vona, Jr. et al. | |
| 5,536,140 | A | | 7/1996 | Wagner et al. | 415/119 |
| 5,554,004 | A | | 9/1996 | Stewart | |
| 5,569,017 | A | | 10/1996 | Barnhart et al. | 415/177 |
| 5,573,369 | A | | 11/1996 | Du | 415/119 |
| 5,720,074 | A | | 2/1998 | Lee | 15/326 |
| 5,755,555 | A | | 5/1998 | Swift | |
| 5,839,374 | A | | 11/1998 | Conner et al. | |
| 5,919,030 | A | * | 7/1999 | Iwatake et al. | 15/326 |
| 6,014,791 | A | | 1/2000 | Nosenchuck | |
| 6,171,054 | B1 | | 1/2001 | Mann, III et al. | |
| 6,336,244 | B1 | * | 1/2002 | Tarutani et al. | 15/326 |
| 6,340,291 | B1 | * | 1/2002 | Reckert | 416/185 |

FOREIGN PATENT DOCUMENTS

| | | | | |
|---|---|---|---|---|
| JP | 59090799 A | * | 5/1984 | 415/218.1 |

OTHER PUBLICATIONS

Photograph of Ametek Fan Motor Housing Model #119339–00 As used on Bissell PowerClean Model 35401. Acquired by Hoover Jul. 20, 1998.

* cited by examiner

*Primary Examiner*—Cheryl J. Tyler
(74) *Attorney, Agent, or Firm*—A. Burgess Lowe; Michael J. Corrigan

(57) ABSTRACT

A motor-fan assembly for a floor care appliance having an improved working air fan for increased performance and noise reduction, a working air fan housing cover having a plurality of spiral shaped grooves, and a motor cooling air fan housing cover with slot shaped vent openings for increased cooling performance. The working air fan has a larger number of blades as compared to conventional fans wherein the blades are of two different lengths arranged in an alternating pattern circumferentially on an annular shaped disc. The blades are spaced closer together to prevent the passage of debris between adjacent blades and also to reduce flow noise. The passage between the edges of the fan blades and the working air fan cover has been widened and made uniform to aid in the passage of debris over the top of the working air fan. The spiral shaped grooves on the working air fan cover breaks the circulation patterns of the working airflow into smaller re-circulation patterns to reduce noise generated in the working air cavity. The slot shaped vent openings in the motor cooling air fan cover are oriented as close as possible to being parallel to the resultant direction of the motor cooling air exiting the motor housing through the vent openings to minimize drag and improve cooling efficiency.

36 Claims, 11 Drawing Sheets

MOTOR-FAN ASSEMBLY FOR A FLOOR CLEANING MACHINE

FIELD OF THE INVENTION

The present invention relates generally to a motor-fan assembly for a floor cleaning appliance. More particularly, the present invention relates to a motor-fan assembly for a floor cleaning appliance having an improved working air fan, fan chamber, and motor cooling fan housing cover design.

BACKGROUND OF THE INVENTION

In the floor care appliance art, a motor-fan assembly is typically used in what are known as "dirty air" systems as a vacuum source for drawing dirt laden air and/or dirty cleaning solution (both hereinafter referred to as dirty working air) through a nozzle and the fan chamber itself before directing it to a filter bag and/or a receptacle for collection and later disposal. A motor-fan assembly may also be used in what are known as "clean air" systems as a vacuum source for creating a suction in the receptacle for drawing the dirt laden air into the receptacle. The floor care appliances referred to include vacuum cleaners of the upright or canister type for vacuuming dirt particles from the floor surface and the extractor type cleaners for scrubbing floors and carpets. Known motor-fan assemblies, therefore, have a working air fan or impeller (hereinafter referred to as working air fan, fan, or impeller) driven by a motor that draws the dirty working air into the fan chamber and expels it through a fan chamber outlet into a receptacle.

In order to meet consumer demand for increased performance in floor care appliances, designers of motor-fan assemblies for such appliances have sought to improve the performance of one or more aspects of the motor-fan assembly. One such aspect is the performance of the working air fan in generating the vacuum source for drawing the dirty air. One other aspect sought to be improved is reducing the noise generated by the working air fan or other parts of the motor-fan assembly. Another aspect sought to be improved is the cooling performance of the motor-fan assembly.

Impellers and fans for use with motor-fan assemblies and the like are well known in the art. There are patents for fans attempting to improve fan performance and reduce noise, fans having spiral blades, and fans less susceptible to impact damage from debris. For example, in U.S. Pat. No. 5,755,555 issued to Swift a rotating fan assembly is provided for use in single stage and multi-stage applications. The fan assembly includes a fan member having a tapered disk member, a flat annular ring member and a plurality of spiral shaped blade members interposed between the disk and the ring. U.S. Pat. No. 5,573,369 issued to Du provides a fan for a vacuum cleaner having a fan housing, a motor and an impeller. The impeller has a hub and multiple blades. The blades have a leading edge that is tapered upward, a top edge that is tapered downward, and a trailing edge that is tapered downward.

However, no patents were found that improve the performance of aforementioned aspects of the motor-fan assembly such as the working air fan, reducing the noise generated by the working air fan or other parts of the motor-fan assembly, or improving the cooling performance of the motor-fan assembly in the manner of the present invention.

Accordingly, an object of the present invention is to improve the performance of a motor-fan assembly for a floor care appliance.

Another object of the present invention is to provide a motor-fan assembly for a floor care appliance with an improved working air fan design.

Yet still another object of the present invention is to provide a motor-fan assembly for a floor care appliance with an improved working air fan that improves debris passage.

Another object of the present invention is to provide a motor-fan assembly for a floor care appliance that reduces working air fan noise.

Yet another object of the present invention is to provide a motor-fan assembly for a floor care appliance with an improved working air fan design that is resistant to impact damage.

These and other objects will be readily apparent to one of skill in the art upon reviewing the following description and accompanying drawings.

SUMMARY OF THE INVENTION

The present invention provides an improved motor-fan assembly for a floor cleaning appliance such as a vacuum cleaner or extractor. In one disclosed embodiment, the motor-fan assembly includes a motor housing having a working air inlet, a working air outlet, a working air fan, and a housing cover for the working air fan cavity having a plurality of spiral shaped grooves on the inner surface for reducing noise. The motor-fan assembly further includes a cooling air inlet, a motor cooling air fan, a housing cover for the motor cooling air fan cavity having a plurality of vent openings of a novel design for improved cooling performance. A motor is supported inside the motor housing. A working air fan is positioned between the working air inlet and the working air outlet and is coupled to the shaft of the motor. The working fan draws working air into the motor housing through the working air inlet and blows the working air out of the motor housing through the working air outlet. The plurality of spiral shaped grooves formed on the inner surface of the housing cover covering the working air fan cavity are for reducing the noise generated in the cavity.

In another form of the present invention, a cooling air fan is positioned adjacent the motor and is coupled to the motor shaft. The cooling fan draws cooling air into the motor housing through the cooling air inlet to cool the motor. The cooling air is exhausted to the atmosphere through the plurality of vent openings located in the motor cooling fan housing cover covering the motor cooling air fan cavity. The plurality of vent openings are slot shaped and are spaced circumferentially about the hub of the motor cooling air fan housing cover.

In still another form of the present invention, the working air is generated by a working air fan having a greater number of fan blades compared to conventional fans having five to seven blades. The top edge of the fan blades are parallel to the inner surface of the working air fan cover to improve the passage of debris over the top of the working air fan. The increased number of closely spaced blades also helps prevent debris from getting stuck between the blades.

In an alternate embodiment of the present invention, the motor cooling air fan housing cover has a plurality of vent openings spaced circumferentially about the hub of the housing cover wherein adjacent vent openings are separated by a planar shaped vane. The airstream cooling the motor-fan assembly exits the motor housing through the plurality of vent openings past the planar shaped vanes.

BRIEF DESCRIPTION OF THE DRAWINGS

For a complete understanding of the objects, techniques and structure of the invention, reference should be made to the following detailed description and accompanying drawings wherein.

DETAILED DESCRIPTION OF THE INVENTION

Figure 1:
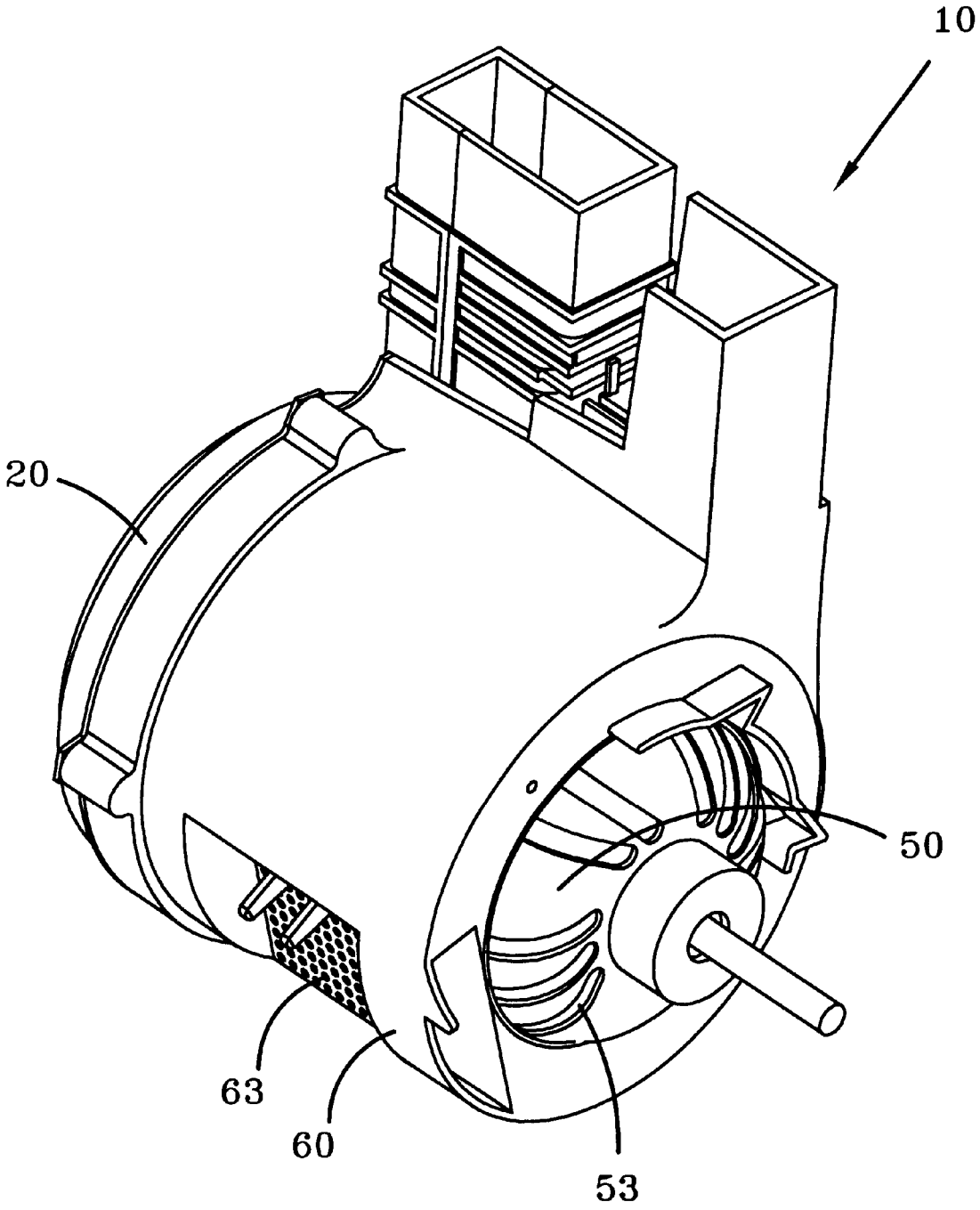
FIG. 1 is a perspective view of motor-fan unit according to the preferred embodiment of the present invention.

Referring now to the drawings and more particularly to FIG. 1, a motor-fan assembly 10 is shown for use in floor cleaning appliances such as upright and canister vacuum cleaners and extractors. Whatever floor cleaning appliance motor-fan assembly 10 is installed in, it is used as a vacuum source for drawing dirt laden air or dirty cleaning solution through a nozzle and directing it into a filter and/or receptacle for collection and later disposal. Motor-fan assembly 10 can be used in what is known as "dirty air" systems wherein the dirt and/or dirty cleaning solution (hereinafter dirty air) comes into direct contact with the working air fan (or impeller) before being directed to a filter and/or receptacle. Motor-fan assembly 10 can also be used in "clean air" systems wherein the dirty air is drawn into the receptacle by a vacuum created by motor-fan assembly 10 on the opposite side of the receptacle. The dirty air never comes into contact with the working air fan. For the purposes of disclosure, motor-fan assembly 10 is described for installation in a "dirty air" type floor cleaning appliance only. The actual shape and design of the motor housing 60 shown in FIG. 1 is of very little consequence to the present invention. The details of the novel portions of the present invention, namely the motor cooling fan housing cover 50, working air fan 30 (not shown), and fan chamber 20 are described fully hereinbelow.

Figure 2:
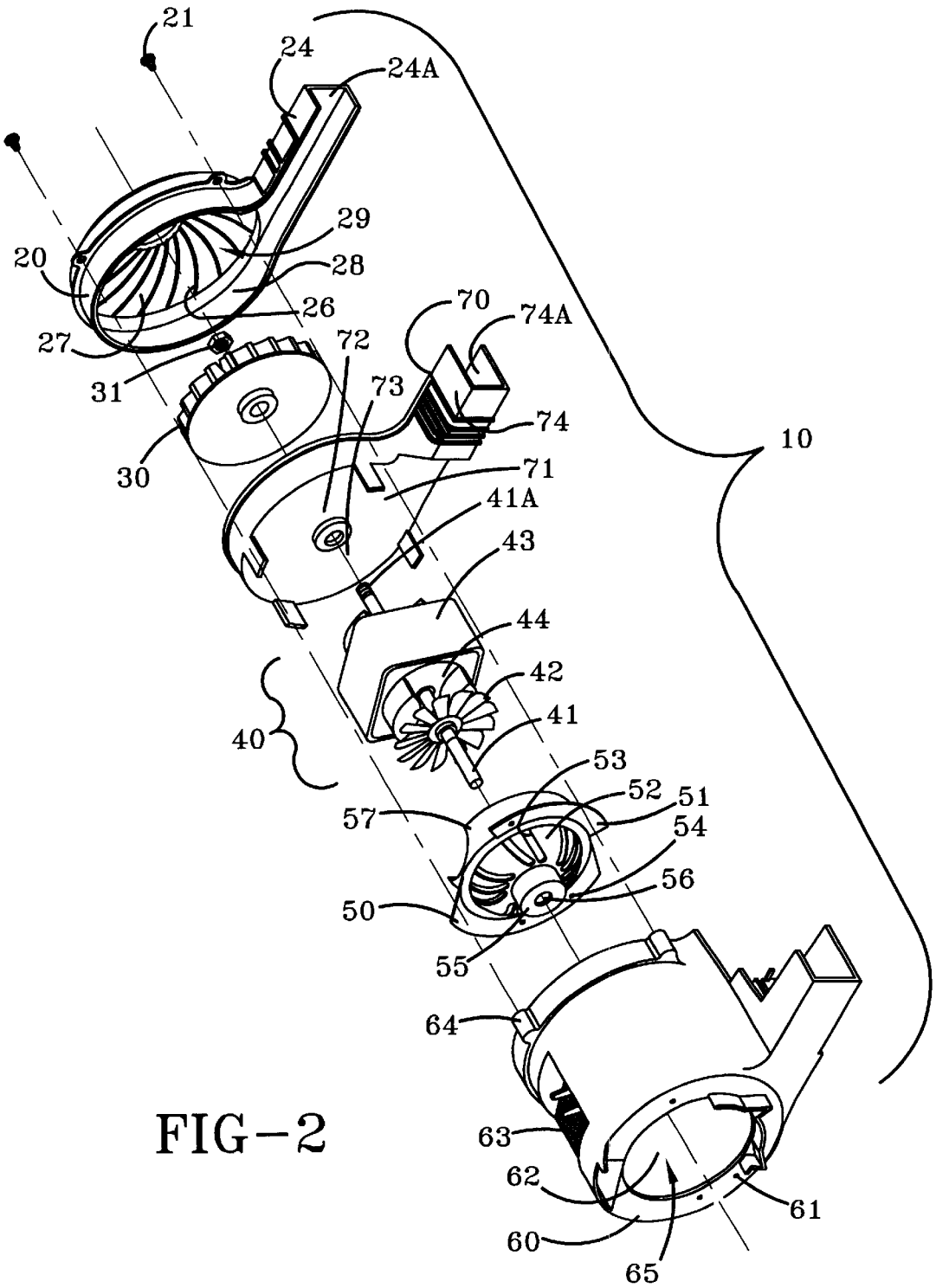
FIG. 2 is an exploded perspective view of the motor-fan assembly shown in FIG. 1.

Referring now to FIG. 2, shown is an exploded perspective view of motor-fan assembly 10. Motor-fan assembly 10 is comprised generally of a motor housing 60, a rotor-cooling fan assembly 40, a motor support 70, a working air fan or impeller 30, a motor-cooling fan housing cover or cap 50, and a fan chamber or working air fan cover 20. Motor-cooling fan housing cover 50 has a plurality of slot shaped vent openings 53 formed in a hemi-spherically shaped plate portion 52 spaced circumferentially around a central hub 55. Hub 55 has an aperture 56 formed in the center for allowing the motor shaft 41 to pass therethrough. Motor-cooling fan housing cover 50 fits into an aperture 62 formed in one end of motor housing 60 such that vent openings 53 extend slightly beyond the plane of the end wall of motor housing 60. The opposite side of motor-cooling fan housing cover 5O has a cooling fan cavity 58 (FIG. 4A) for receiving cooling fan 42 of rotor-fan assembly 40. Two or more lips 51 extend from the periphery of the plate portion 52 for securing motor-cooling fan housing cover 50 to the end wall of motor housing 60. Apertures 54 in lip 51 of motor-cooling fan housing cover 50 are aligned with apertures 61 in the end wall of motor housing 60 to secure motor-cooling fan housing cover 50 and motor housing 60 together. Rivets or screws or the like may be used in apertures 54 and 61. Alternately, motor-cooling fan housing cover 50 may be integrally formed on the end of motor housing 50 eliminating the need for attaching it separately. Of course, vent openings 53 would also have to be formed integrally therein. A plurality of cooling air inlet openings 63 are formed on the sidewall of motor housing 60 to allow the cooling air to be introduced into motor housing 60.

As discussed, rotor-fan assembly 40 is inserted into cavity 58 (FIG. 4A) of motor-cooling fan housing cover 50 such that cooling fan 42 is free to rotate therein. Motor shaft 41 of rotor-fan assembly 40 is inserted into aperture 56 in hub 55 of motor-cooling fan housing cover 50 wherein hub 55 acts as a bearing for motor-shaft 41. Motor shaft 41 extends from rotor 44 containing the field windings. Rotor 44 is surrounded by stator 43 also containing windings for generating the electromotive forces to drive motor-shaft 41. Extending from an opposite end of rotor 44 is another section of motor-shaft 41 having a threaded section 41*a* on the end. Threaded section 41*a* of motor-shaft 41 is inserted into an aperture 73 in motor support 70. A plurality of arms 71 extend sidewardly from a base portion 72 of motor support 70. Arms 71 define a cradle for receiving and holding rotor-fan assembly 40. A U-shaped channel portion 74 extends outwardly from base portion 72 for the purpose described in more detail further hereinbelow. Motor-shaft 41 extends further past base portion 72 of motor support 70 to receive working air fan 30. Working air fan 30 is bolted to motor-shaft 41 via bolt 31 and threaded section 41*a* of motor shaft 41. Fan chamber 20 is then attached by screws 21 or the equivalent over working air fan 30 to seal motor housing 60 with working air fan 30 being received by a working air cavity or working air chamber 29 formed in fan chamber 20. A plurality of bosses 64 with apertures formed therein (not shown) are formed around the outer periphery of motor housing 60 for receiving screws 21. The attachment of fan chamber 20 to motor housing 60 sandwiches motor support 70 between fan chamber 20 and rotor-fan assembly 40. Rotor-fan assembly 40 is also thereby secured in an inner chamber 65 of motor housing 60. When fan chamber 20 is attached to motor housing 60, working air cavity 29 is sealed by motor support 70 creating a working air cavity 29 wherein the suction is created for the working airstream. A U-shaped channel portion 24 extends sidewardly from fan chamber 20 which mates with the U-shaped channel portion 74 of motor support 70 to form a rectangular shaped exhaust conduit or channel 75 for the working airstream to exhaust from within working air cavity 29 of fan chamber 20. An inlet aperture 23 is in the center of the annular main body portion of fan chamber 20 which is generally connected to the nozzle (not shown) of the floor cleaning appliance to draw the dirty airstream into working air cavity 29.

Figure 3A:
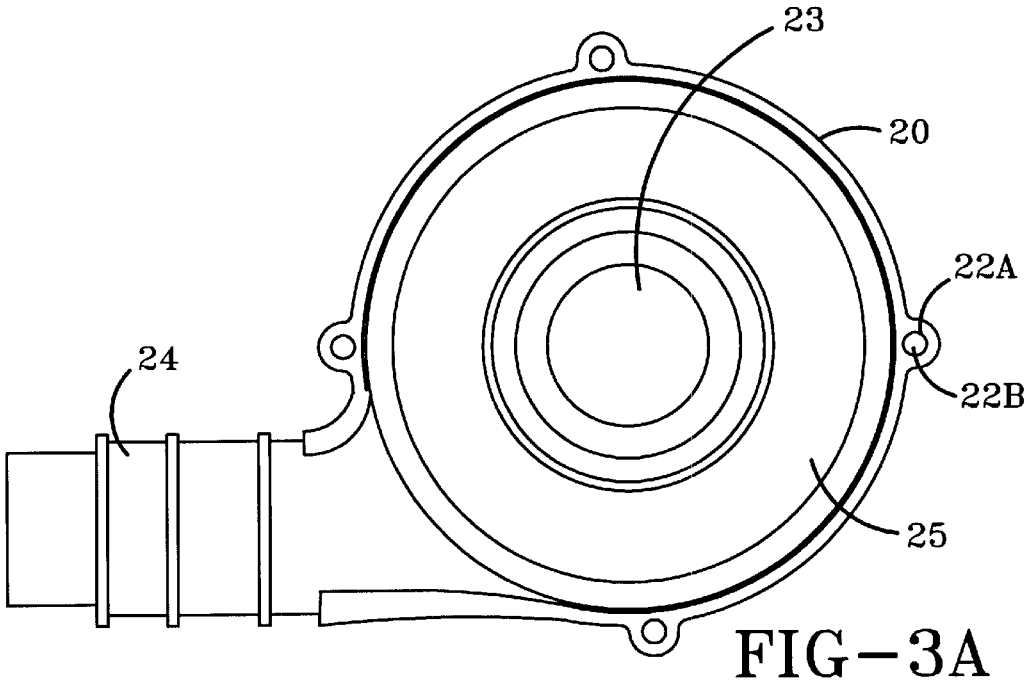
FIG. 3A is front view of a fan chamber for use with a motor-fan assembly such as the one shown in FIG. 1.
Figure 3B:
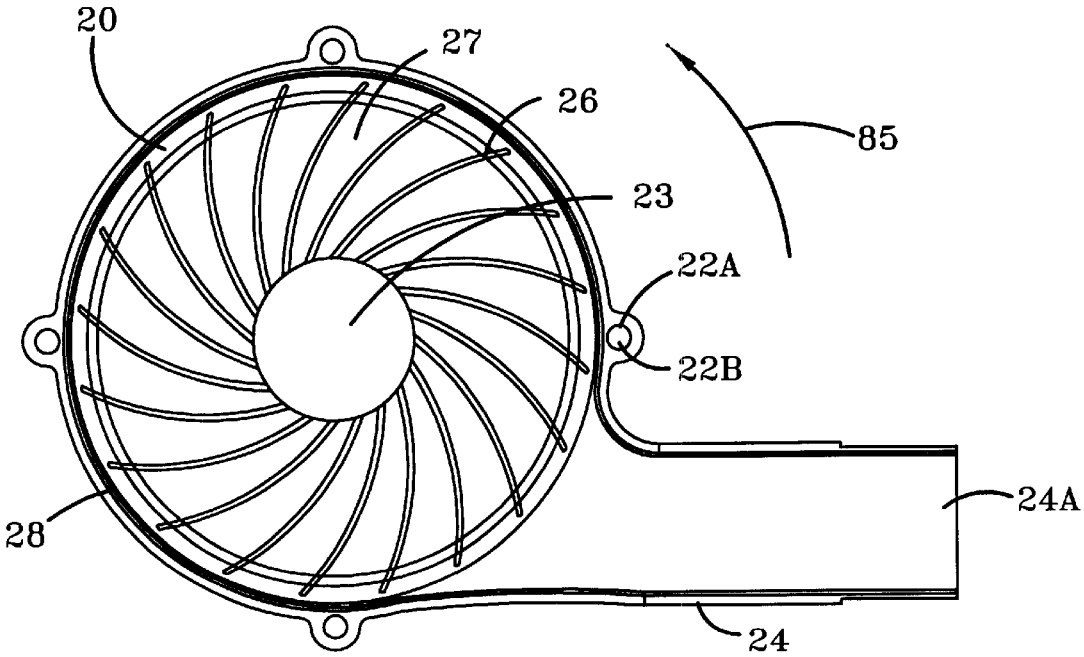
FIG. 3B is rear view of the fan chamber shown in FIG. 3A showing the spiral grooves formed on the inner surface thereof.

Referring now to FIGS. 3A to 3D, shown is more detail of fan chamber 20. FIG. 3A is a front view of fan chamber 20 showing the detail of the exterior surface 25 of fan chamber 20. Inlet aperture 23 is shown in the center and a U-shaped channel portion 24 extends sidewardly to the left from fan chamber 20. A plurality of eyelets 22*a* are formed around the outer periphery of fan chamber 20 having an aperture 22*b* formed therein for allowing screws 21 (FIG. 2) to pass therethrough for attaching fan chamber 20 to motor housing 60. FIG. 3B shows the inner surface 27 of fan chamber 20 which is bordered by a sidewall 28 which surrounds the majority of the inner surface 27 of fan chamber 20 except for the portion leading into the U-shaped channel portion 24. Sidewall 28 transitions into the opposing sidewalls of U-shaped channel portion 24 to direct the dirty airstream out of working air cavity 29. A plurality of spiral shaped grooves 26 extend from inlet aperture 23 to sidewall 28 for creating a disturbance in the airflow near inner surface 27. The airflow generated by the working air fan 30 (not shown) rotates in the direction of arrow 85, which is opposite to the direction of spiral of the plurality of spiral grooves 26. Grooves 26 are spaced equi-distant from each other circumferentially about inlet aperture 23. The original re-circulation patterns of the generated airstream are broken into smaller re-circulation patterns that reduce the noise produced near the motor fundamental frequency, and its first few harmonics (between 300 and 1600 Hz). The shape and depth of the grooves 26 affect the noise and the air performance as well. In the preferred embodiment, the shape of the grooves are 0.04 inch deep by 0.08 inch wide with an outward spiral which is opposite to the fan rotational direction.

Figure 3C:
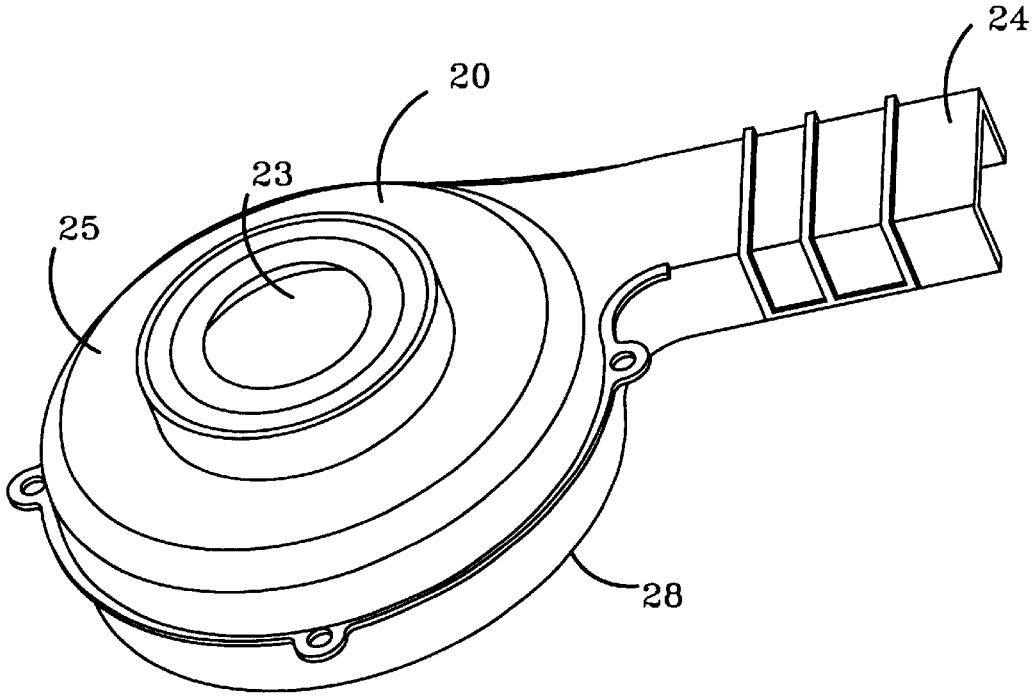
FIG. 3C is a slightly elevated side view of the fan chamber shown in FIG. 3A.
Figure 3D:
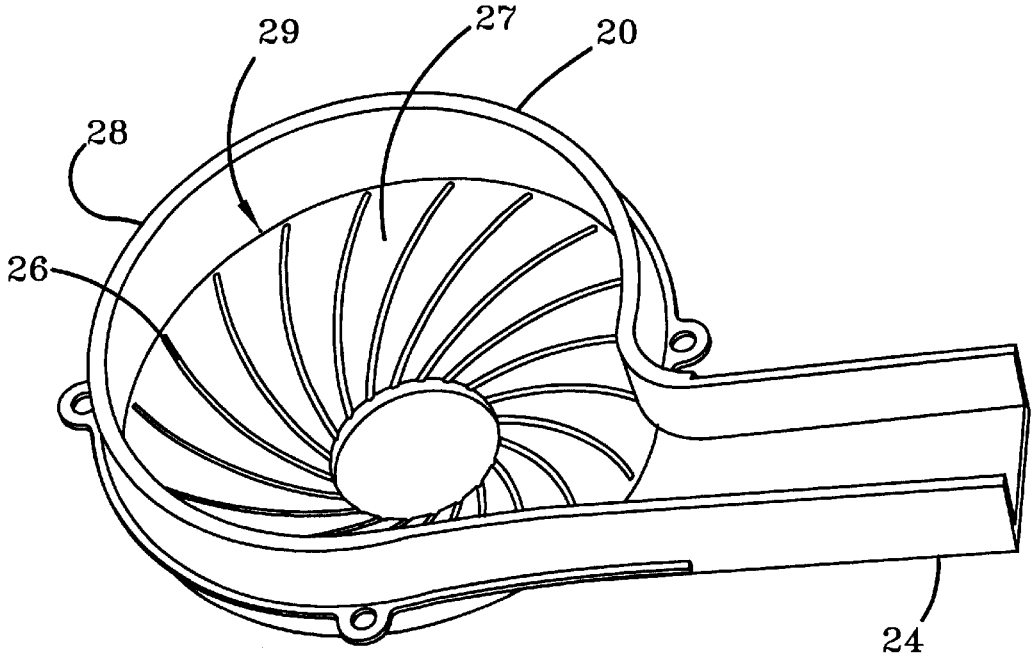
FIG. 3D is a slightly elevated side view of the opposite side thereof of the fan chamber shown in FIG. 3A showing the details of the working air fan cavity.

Additional views of fan chamber 20 can be seen in FIGS. 3C and 3D. FIG. 3D shows the orientation of sidewall 28 and inner surface 27 relative to each other and to the remaining portions of fan chamber 20. Sidewall 28 is straight and is perpendicular to the plane intersecting the outer perimeter of inner surface 27. The inner surface 27 extends in the radial direction from the plane intersecting the outer perimeter of inlet aperture 23 to sidewall 28. Inner surface 27 is linear in the radial direction and in the preferred embodiment is angled at 35° C. off of the plane intersecting the outer perimeter of inner surface 27. The importance of these relationships is discussed hereinbelow. FIG. 3D shows the detail of working air cavity 29 which receives working air fan 30 and the plurality of spiral grooves 26 formed on inner surface 27.

Figure 4A:
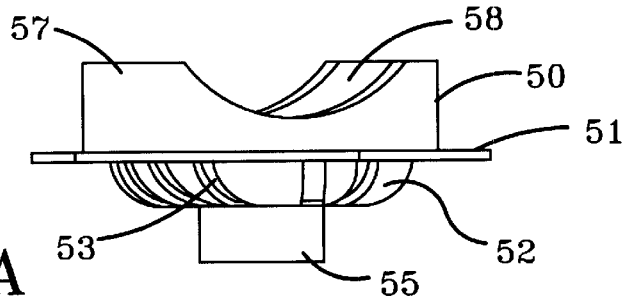
FIG. 4A is a side view of a preferred embodiment of a motor cooling fan housing cover having a plurality of vent openings for use with a motor-fan assembly such as the one shown in FIG. 1.
Figure 4B:
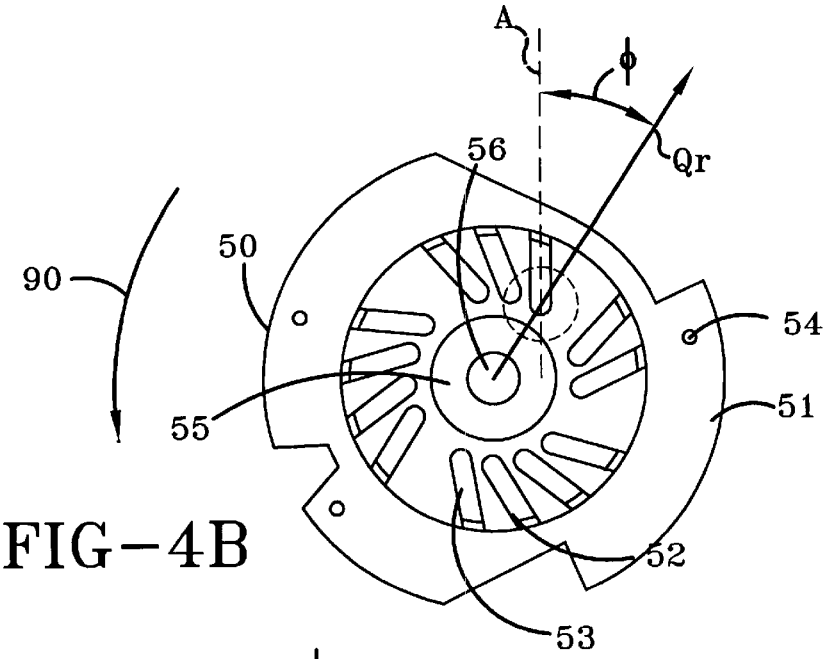
FIG. 4B is a front view of the motor cooling fan housing cover shown in FIG. 4A showing the angular relationship $\phi$ between the plane of the longitudinal axis A of a vent opening and the radial axis Qr of the motor cooling fan housing cover.

Referring now to FIGS. 4A–4F, shown is motor cooling fan housing cover 50 and the plurality of slot shaped vent openings 53 spaced circumferentially about hub 55. Specifically, FIG. 4A shows a side view of motor cooling fan housing cover 50, which is comprised of a truncated semi-hemispherical shaped top plate 52, an annular shaped hub 55 integrally molded on the geometric center of the truncated region of top plate 52, a lip 51 surrounding the periphery of top plate 52, and an annular ring 57 attached to the side of top plate 52 and lip 51 opposite hub 55. The truncated hemispherical shape of top plate 52 gives the outer periphery a rounded appearance and a portion having a finite width extending beyond the plane of lip 51. Motor cooling fan 42 (not shown) is received into a cavity 58 on the side of lip 51 opposite top plate 52. As discussed, when motor cooling fan housing cover 50 is inserted into the aperture 61 (FIG. 2) of motor housing 60 (FIG. 2), the portion of top plate 52 having finite width extends beyond the plane of the end wall of motor housing 60 (FIG. 2). FIG. 4B shows a front view of motor cooling fan housing cover 50 and the plurality of vent openings 53 formed in top plate 52 and spaced circumferentially around hub 55. Also seen is hub aperture 56 in the center of hub 55 and top plate 52 for receiving motor shaft 41 (not shown). Motor cooling fan 42 (not shown) and motor shaft 41 (not shown) rotate counter-clockwise in the direction of arrow 90. In the preferred embodiment of the invention, there are 13 vent openings 53 formed in top plate 52 in the arrangement shown. In an alternate embodiment of the present invention, there are seventeen vent openings 53 in top plate 52. However, the number of vent openings 53 in top plate 52 in either the preferred embodiment or the alternate embodiment is not limiting in that any number of vent openings 53 can be selected as a matter of design choice.

Figure 4C:
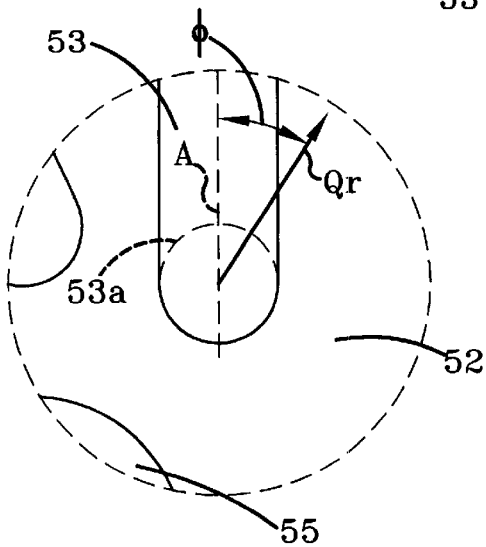
FIG. 4C is an exploded view of a portion of the motor cooling fan housing cover shown in FIG. 4B.
Figure 4D:
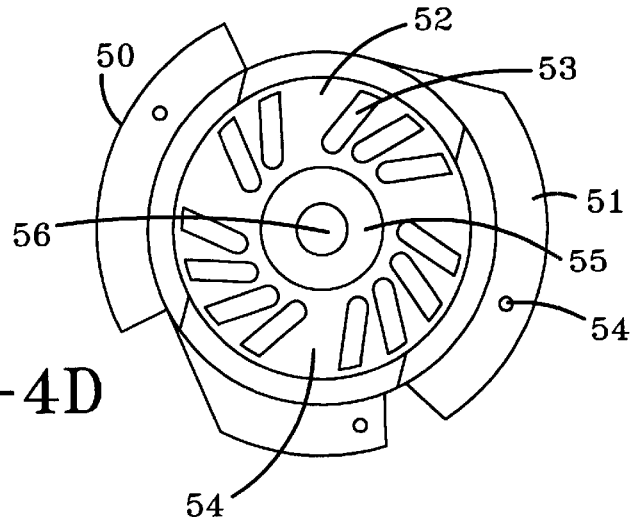
FIG. 4D is a rear view of the motor cooling fan housing cover shown in FIG. 4A.
Figure 4E:
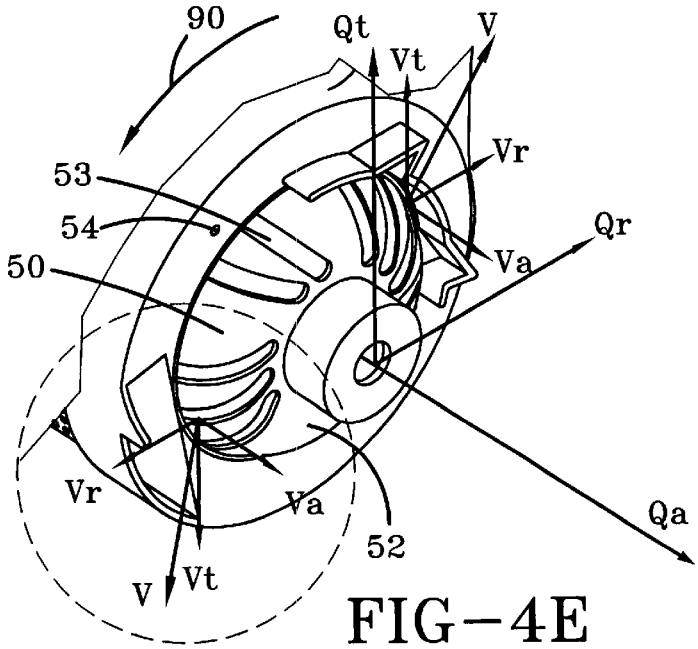
FIG. 4E is a partial cutaway view of a motor-fan assembly such as the one shown in FIG. 1 showing the major axes of the motor-cooling fan housing cover shown in FIG. 4A and the individual directional components of the cooling airstream flowing through the plurality of vent openings in the direction of the major axes.
Figure 4F:
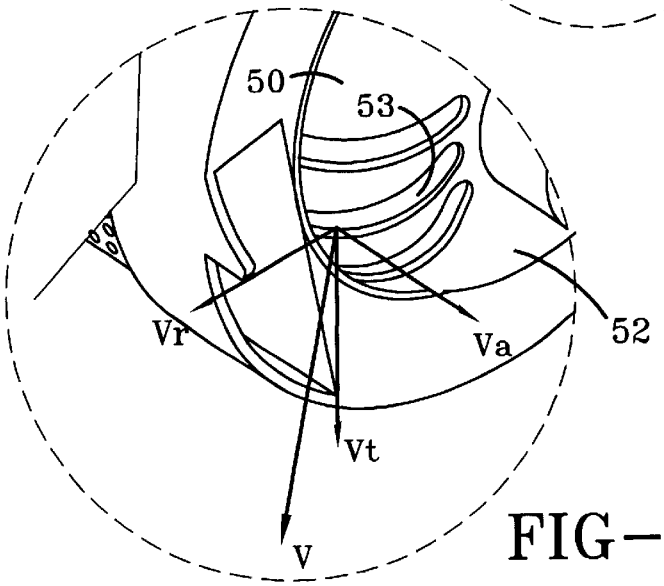
FIG. 4F is an exploded view of a portion of the motor cooling fan housing cover shown in FIG. 4E showing the detail of the individual directional components of the cooling airstream flowing through one of the plurality of vent openings in the direction of the major axes.

Each of said vent openings 53 are an elongated slot shape having parallel sides that terminate at one end at the outer periphery of top plate 52. The opposite end of each of the plurality of vent openings 53 is rounded and is defined by a circle 53*a* (FIG. 4C) having a center. The center of the circle 53*a* of each of said plurality of vent openings is equidistant from the geometric center of top plate 52. The plurality of vent openings 53 each have a longitudinal axis A parallel to the opposing parallel sides of the aforesaid vent openings 53. Each of the plurality of vent openings 53 are oriented in this fashion so that the direction of the cooling airstream exiting inner chamber 65 of motor housing 60 through said plurality of vents openings 53 is parallel to or approximately parallel to the plane of the longitudinal axis A of each of the plurality of vent openings 53. The direction and speed of the cooling airstream flowing through the plurality of vent openings 53 is the vector V which is the vector sum of the individual components of the airstream Va, Vr and Vt and illustrated in FIG. 4E. Generally, motor cooling fan housing cover 50 has three major axes which define the directions of the individual components of the airstream. The axial direction of the cooling airstream is defined by the axis Qa, the radial direction by Qr, and the tangential direction by Qt shown in FIG. 4E. The axial component of the airstream is represented in FIG. 4E (and in exploded view FIG. 4F) by Va, the radial component by Vr, and the tangential component by Vt. The vector sum of Va, Vr, and Vt is represented by V which is in the resultant direction of the airstream from motor-cooling fan 42. The direction of the rotation of motor-cooling fan 42 is in the direction of arrow 90. The direction of the plane of the longitudinal axis A of each of the vent openings 53 is desired to be parallel or approximately parallel to V. This direction can be described by the angle between the plane of the longitudinal axis A of each of the vent openings 53 and the radial axis Qr of motor cooling air housing cover 50 which is defined by a radial line passing through the geometric center of top plate 52 and the center of the circle 53*a* defining each of the rounded ends of the plurality of vent openings 53. This relationship is illustrated in FIGS. 4B and 4C wherein $\phi$ represents the angle between the plane of the longitudinal axis A of each of the vent openings 53 and the radial axis Qr of motor cooling air housing cover 50. Since the direction of the cooling airstream exiting through vent openings 53 is parallel or approximately parallel to the plane of the longitudinal axis A of each of vent openings 53, the drag created by the moving airstream through vent openings 53 is minimized thus improving cooling efficiency. A reduction in noise is also obtained since the airstream is disturbed less as it exits through each of the vent openings 53. In the preferred embodiment of the present invention, the angle $\phi$ between the plane of the longitudinal axis of each vent opening 53 and the radial axis Qr intersecting the geometric center of said top plate 52 and the center of the circle defining the rounded end of the vent opening 53 is 60°. The angle $\phi$ stated herein is non-limiting in that the angle chosen is a matter of design choice based upon the direction of the airstream exiting through vent openings 53 which could vary based upon such factors as the speed of fan 42, size of motor housing 60, and other factors. The angle $\phi$ could vary in the range of 0° to 75°. FIG. 4D shows further detail of the rear side of motor cooling fan housing cover 50 including cavity 57 for receiving cooling fan 42.

Figure 5A:
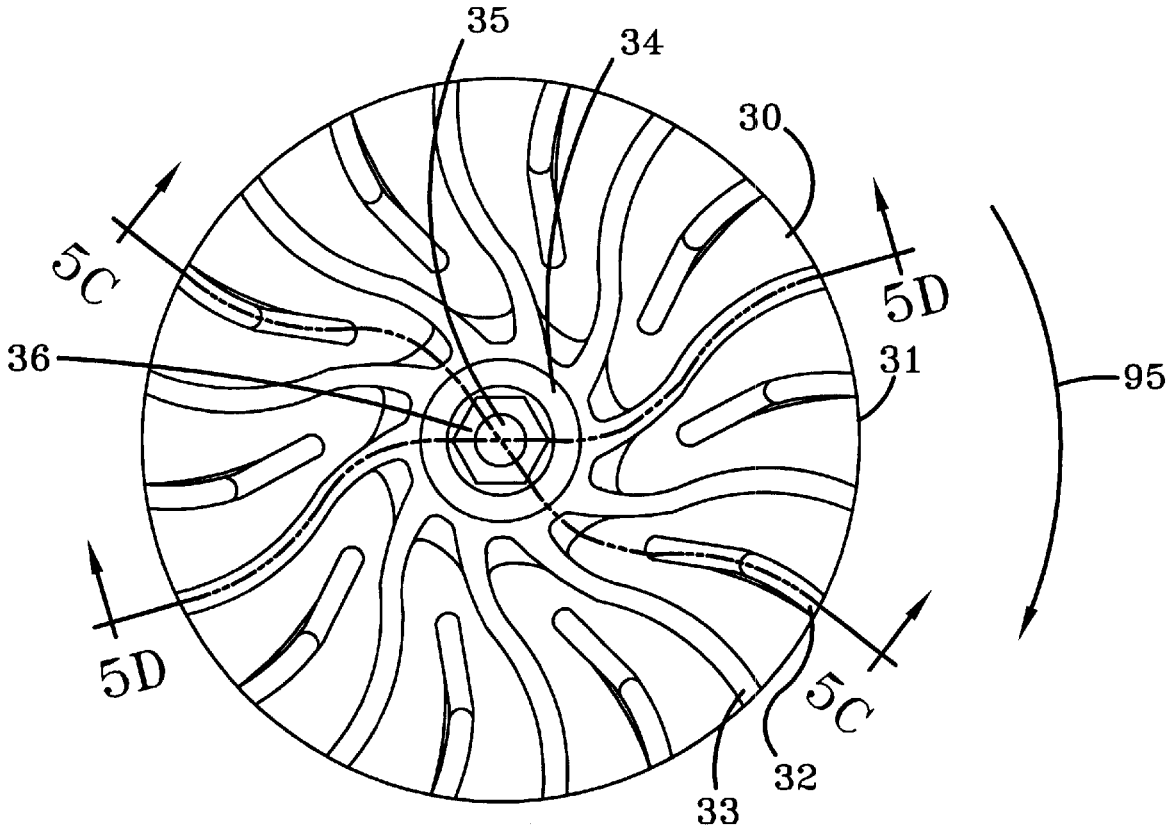
FIG. 5A is a top view of a working air fan for use in a motor-fan assembly such as the one shown in FIG. 1.
Figure 5B:
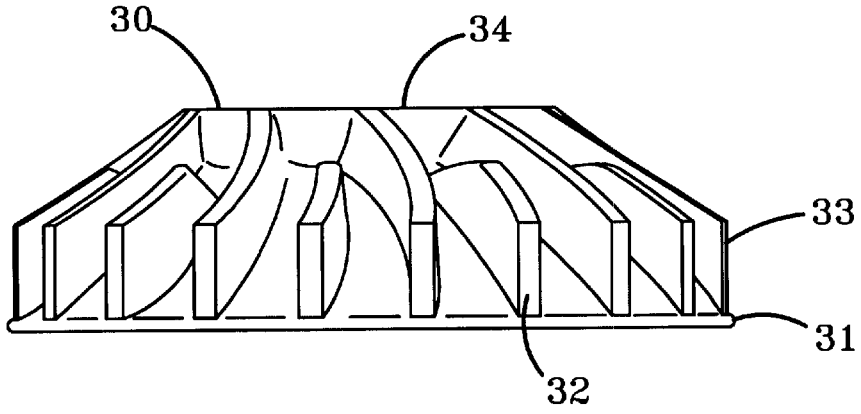
FIG. 5B is a side view of the working air fan shown in FIG. 5A.

Referring now to FIGS. 5A–5D, shown is fan 30 used for generating the working airstream inside working air cavity 29 of fan chamber 20. Working air fan 30 is generally annular in shape having a plurality of blades 32 and 33 of two different radial lengths. Blades 32 and 33 are placed in an alternating arrangement and integrally molded on the upper surface of an annular shaped disc 31. Working air fan blades 32 and 33 are of a curvilinear shaped design being forward swept at the trailing edges to increase blade loading and reduce noise as fan 30 is rotated in a clockwise direction as shown by arrow 95 in FIG. 5A. The longer length fan blades 33 are spaced circumferentially about a hub portion 34 located in the geometric center of disc 31. The longer length fan blades 33 extend from the outer periphery of hub portion 34 to the outer periphery of disc 31. The working air fan blades 33 are backswept at the hub portion 34. Formed in the center of hub portion 34 is a hexagonal shaped cavity 36 for receiving and holding fast nut 31 (FIG. 2). Thus, fan 30 can be bolted to the threaded end 41*a* (FIG. 2) of motor shaft 41 (FIG. 2). The shorter length fan blades 32 are also arranged circumferentially around hub portion 34 wherein one of the shorter length fan blades 32 is located in between adjacent longer length fan blades 33. The shorter length fan blades 32 extend from the outer periphery of disc 31 a distance less than the full distance from the outer periphery of disc 31 to the outer periphery of hub portion 34. The length of fan blades 32 was selected based upon empirical testing such there was enough space for efficient airflow between each of fan blades 32 and adjacent fan blades 33 but not so much space that debris could enter the space and become lodged therein between fan blades 32 and 33. The leading edges 32*l* of fan blades 32 are linear or may be slightly arcuate extending from the upper surface of disc 31 to the top edges 32*t* of fan blades 32. The leading edge 32*l* of fan blades 32 are sloped in the radial direction to promote efficient airflow and to guide debris that may attempt to enter the space just forward of fan blades 32 out of the space and over the top edge 32*t* of fan blades 32. Conventional fan blades for use in floor care appliances use a much less number of blades to allow debris to pass between adjacent blades. Although accepted practice, large debris can become lodged between adjacent fan blades in conventional fan blades and over time cause failure of the fan blades from the numerous debris impacts. The fan 30 of the present prevents the debris from passing between adjacent blades 32 and 33 to improve the passage of debris through working air fan cavity 29 by preventing the possibility of debris from becoming lodged in the space between adjacent fan blades 32 and 33. FIG. 5B shows a side view of fan 30 showing the detail of fan blades 32 and 33 formed on the upper surface of disc 31.

Figure 5C:
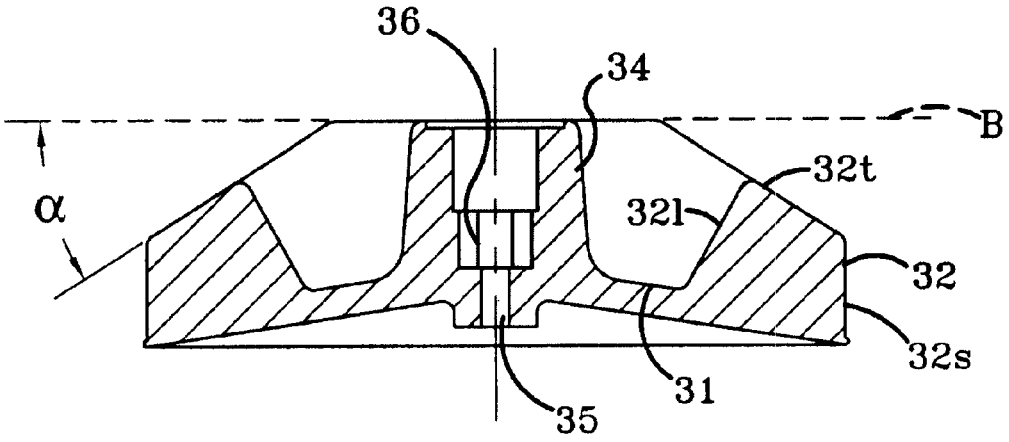
FIG. 5C is a cross-sectional view of the working air fan shown in FIG. 5A taken along line 5C—5C of FIG. 5A.
Figure 6:
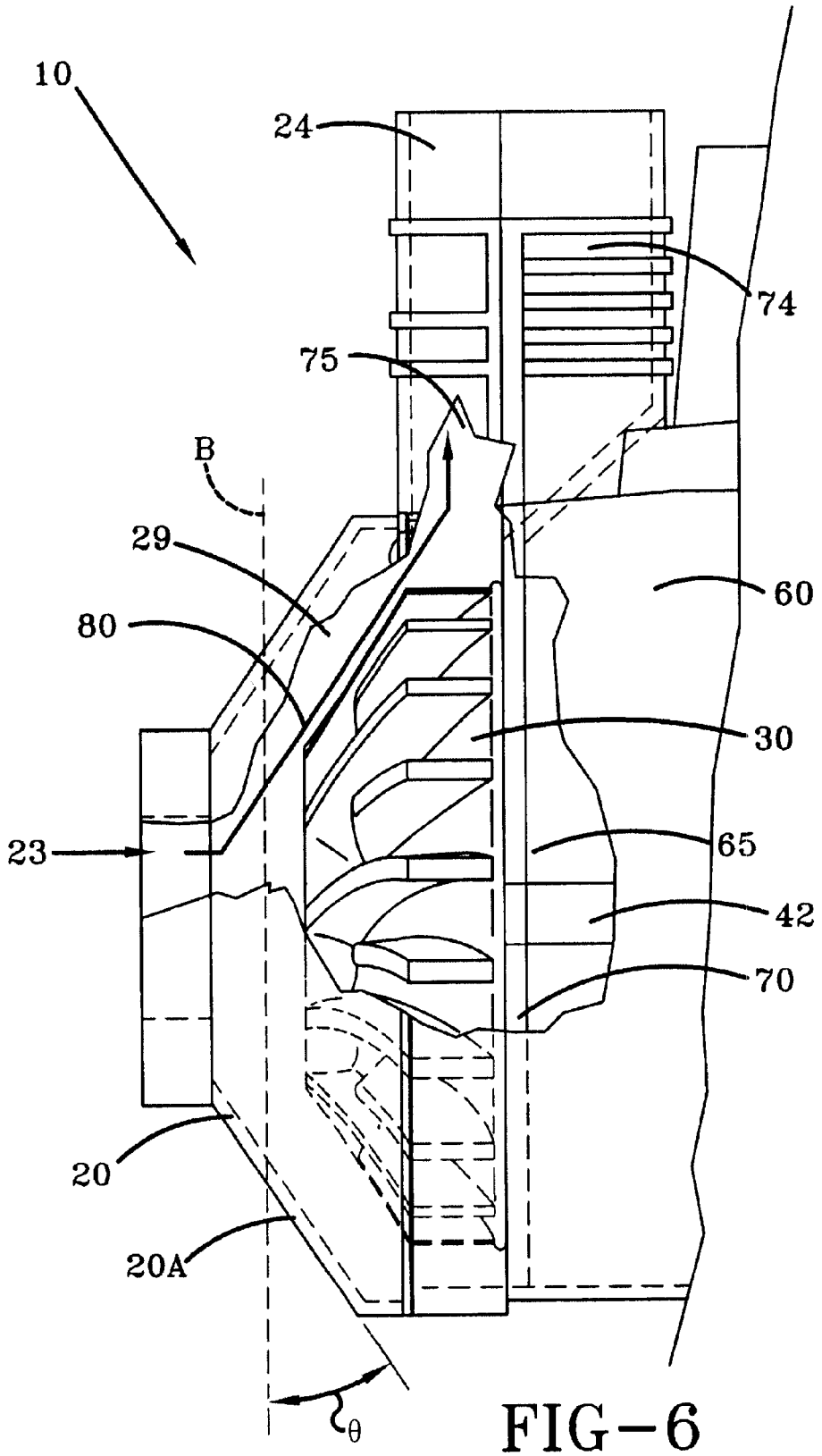
FIG. 6 is a partial cutaway side view of a motor-fan assembly such as the one shown in FIG. 1 with a partial cutaway view of the fan chamber and the motor housing showing the details of the working air fan, fan cavity and the passage of debris over the working air fan to the exhaust conduit.

FIG. 5C shows a cross-sectional side view of fan 30 taken along line 5C—5C of FIG. 5A through the center point of disc 31 and aperture 35 and cutting through a pair of fan blades 32 located directly opposite each other on opposite sides of hub portion 34. This view shows the details of fan blades 32 wherein the leading edge 32*l* of fan blade 32 extends from the upper surface of disc 31 to the top edge 32*t* of fan blade 32. Fan blade 32 slopes upwardly in a radially outward direction as it extends from the upper surface of disc 31 to the top edge 32*t* of blade 32. The leading edge 32*l* of blade 32 may be linear or slightly arcuate. As discussed, this sloping leading edge 32*l* guides debris out of the space just forward of fan blade 32 over the top edge 32*t* of fan blade 32 so that the debris is passed to the exhaust outlet (FIG. 6) of fan chamber 20 (FIG. 6). The top edge 32*t* of fan blade 32 extends in the radially outward direction from a point between hub portion 34 and the outer periphery of disc 31 to the outer periphery of disc 31. Fan blade 32 is at its maximum height at this point and at its minimum height at the outer periphery of disc 31. Thus, the top edge 32*t* of fan blade 32 slopes downwardly in the radially outward direction. The slope of fan blades 32 is an angle $\propto$ as measured from the plane designated as plane B represented as a dashed line in FIG. 5C. Plane B is the plane parallel to the upper surface of hub 34. The angle $\propto$ is a matter of design choice but in the preferred embodiment $\propto$ is 35°. The top edge 32*t* of fan blades 32 is linear or may be slightly arcuate. Fan blades 32 project orthogonally upward from disc 31, or in other words, perpendicularly from the plane of disc 31. The trailing edge 32*s* of fan blades 32 is linear only and perpendicular to the plane of disc 31 and plane B.

Figure 5D:
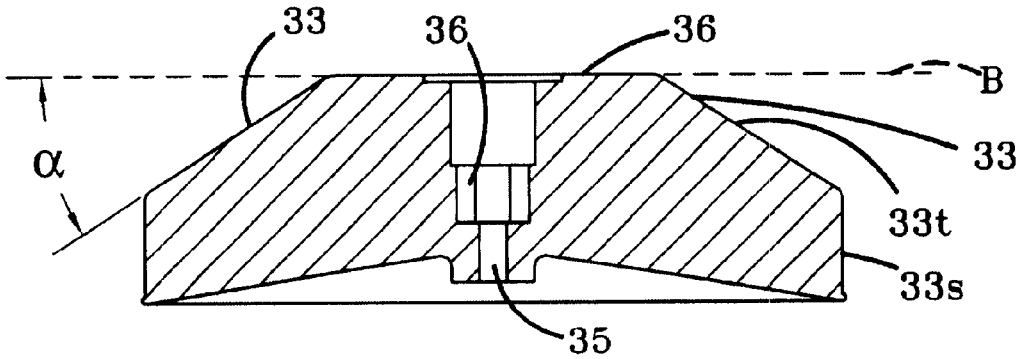
FIG. 5D is a cross-sectional view of the working air fan shown in FIG. 5A taken along line 5D—5D of FIG. 5A.

FIG. 5D shows a cross-sectional side view of fan 30 taken along line 5D—5D of FIG. 5A. The top edge 33*t* of fan blades 33 can be seen extending in the radially outward direction from hub portion 34 to the outer periphery of disc 31. Fan blades 33 are at their maximum height at the point where fan blades 33 meet the upper surface of hub portion 34. Fan blades 33 are at their minimum height at the trailing edge 33*s* on the outer periphery of disc 31. Fan blades 33 slope downwardly in the radially outward direction from their maximum height at hub portion 34 to their minimum height at the periphery of disc 31. The slope of fan blades 33 is an angle $\propto$ as measured from plane B. The angle $\propto$ is a matter of design choice but in the preferred embodiment ∝ is 35°. The top edges of fan blades 33 are linear or may be slightly arcuate. Fan blades 33 project orthogonally upward from disc 31, or in other words, perpendicular from the plane of disc 31. The trailing edges of fan blades 33 are linear only and are perpendicular to the plane of disc 31 and plane B.

FIG. 6 shows a partially cutaway side view of fan chamber 20 installed on a partially cutaway portion of motor housing 60. A portion of fan 30 inside working air fan cavity 29 can be seen through the cutaway. Arrow 80 shows the path that debris entering inlet aperture 23 of fan chamber 20 must take through working air fan cavity 29 to get to exhaust channel 75. The dual length design of the fan blades 32 and 33 and the close spacing between adjacent fan blades prevents large debris from traveling in the space between the fan blades. The gap between the top edges 32*t*, 33*t* of fan blades 32 and 34 and inner surface 27 of fan chamber 20 is wider than in conventional motor-fan assemblies so that large objects and debris can pass over the top of fan 30 to exhaust channel 75. The slope of the sidewall 20A of fan chamber 20 in the region surrounding fan 30 as measured relative to plane B, and represented by the angle ⊖, is equal to the downward slope of the top edges 32*t*, 33*t* of fan blade 32 and 33 as measured relative to plane B, and represented by the angle ∝ in FIGS. 5C and 5D, so that the gap between the top edges 32*t*, 33*t* of fan blades 32 and 33 and the sidewall 20A of fan chamber 20 is uniform along the entire length of the top edges 32*t*, 33*t* of fan blades 32 and 33. The sidewall 20A of fan chamber 20 in this region slopes downwardly in the radial direction. The sidewall 20A of fan chamber 20 is straight in the radial direction or may be slightly arcuate. If the sidewall 20A of fan chamber 20 is arcuate, the top edges 32*t*, 33*t* of fan blades 32 and 33 are likewise arcuate. Regardless of whether the top edges 32*t*, 33*t* of fan blades 32 and 33 and the sidewall 20A of fan chamber 20 in the radial direction is straight or arcuate, the gap between the top edges 32*t*, 33*t* of fan blades 32 and 33 and the sidewall 20A of fan chamber 20 in the radial direction remains uniform. Hence, the top edges 32*t*, 33*t* of fan blades 32 and 33 and the sidewall 2OA of fan chamber20 in the radial direction are parallel so that there is a clear passage for debris to flow to exhaust channel 75. Sidewall 28 of fan chamber 20 extends downwardly from the outer periphery of fan cover 20 on the side of fan cover 20 opposite inlet aperture 23. Sidewall 28 extends downwardly from the outer periphery of fan chamber 20 perpendicular to plane B and the plane cutting through the outer periphery of fan chamber 20. Thus, the trailing edges 32*s*, 33*s* of fan blades 32 and 33 are parallel along their entire length to sidewall 28 on the outer periphery of fan chamber 20.

Figure 7:
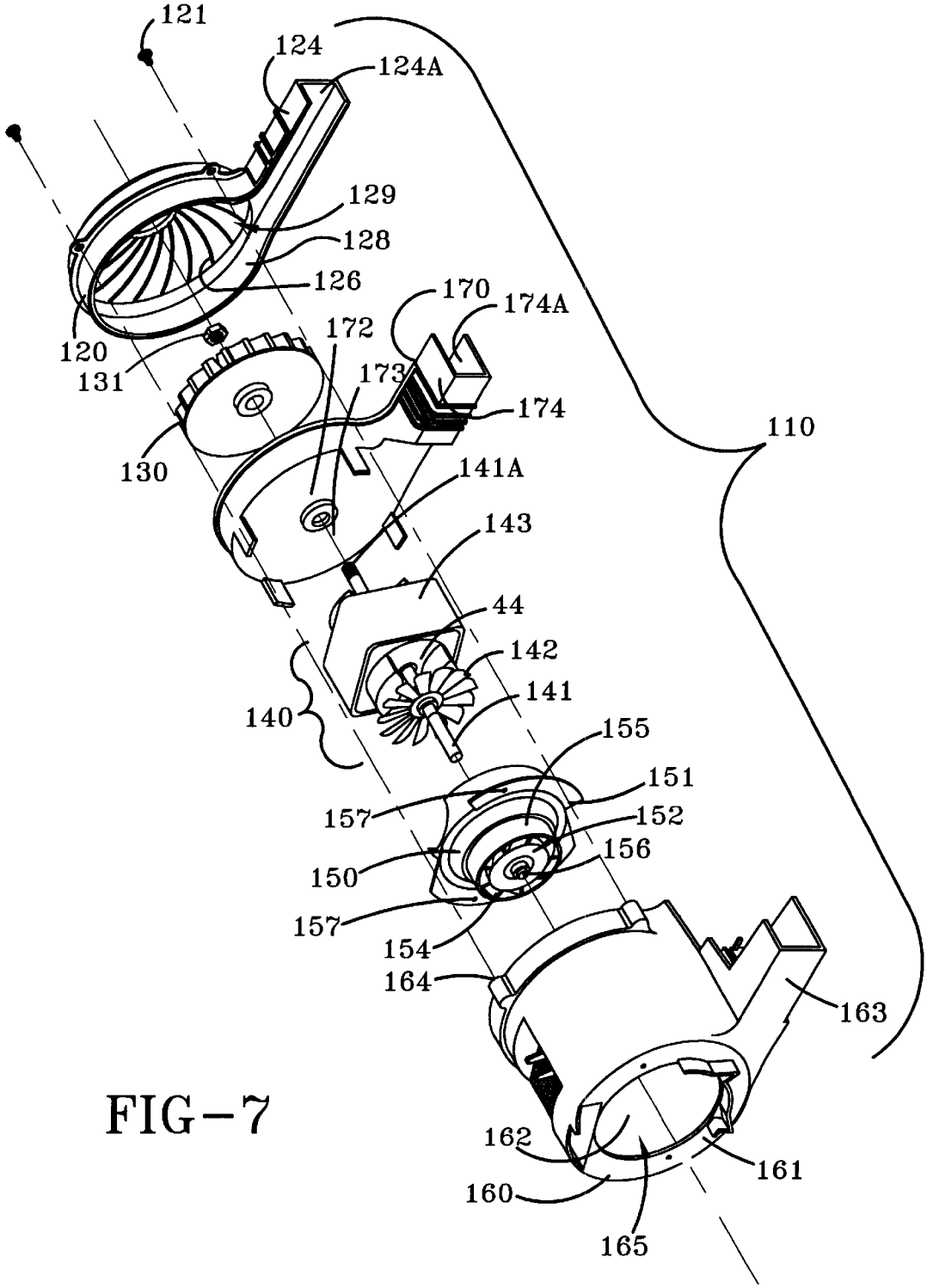
FIG. 7 is an exploded perspective view of an alternate preferred embodiment of a motor-fan assembly.

Referring now to FIG. 7, shown is an alternate preferred embodiment of motor-fan assembly 110. Motor-fan assembly 110 is similar to motor-fan assembly 10 in FIGS. 1–6. However, motor cooling fan housing cover 150 has been substituted for motor cooling fan housing cover 50. Motor-fan assembly 110 may include a working air fan such as working air fan 30 or some other working air fan designated hereafter as working air fan 130. Motor-fan assembly 110 may include a fan chamber such as fan chamber 20 or some arrangement of working air fan chamber or working air fan housing cover designated hereinafter as fan chamber 120. Motor cooling fan housing cover 150 is installed in a motor housing 160 in the same manner as in the preferred embodiment. The remainder of motor-fan assembly 110 is typical of motor fan assemblies so the remainder of the disclosure will focus on the structure of motor cooling fan housing cover 150 only in FIGS. 8A and 8B.

Figure 8A:
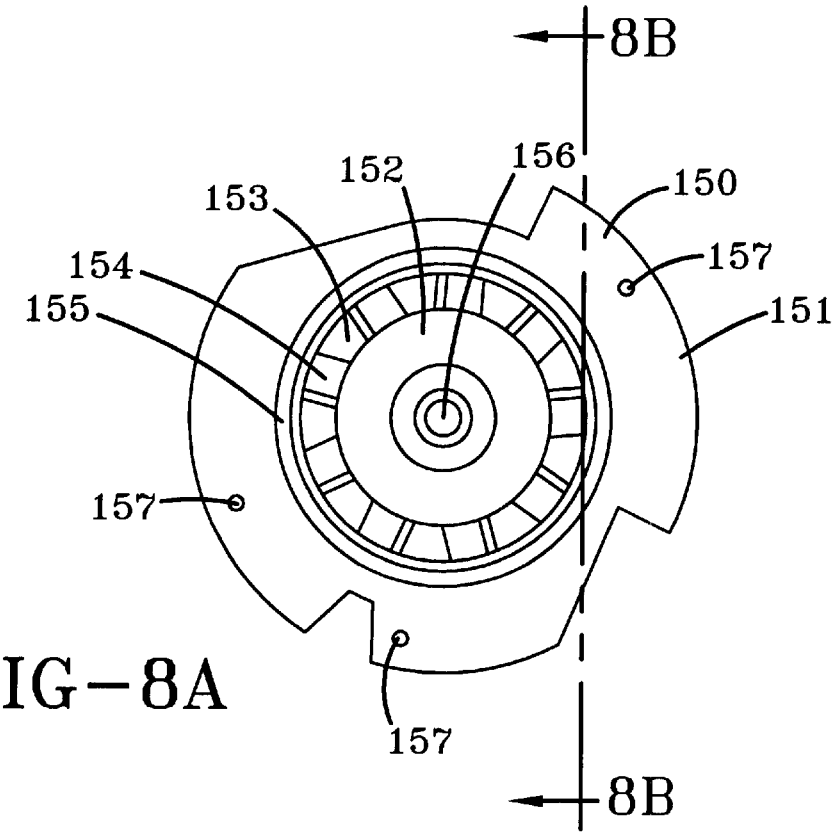
FIG. 8A is a front view of an alternate preferred embodiment of a motor cooling fan housing cover for use with a motor-fan assembly such as the one shown in FIG. 7.
Figure 8B:
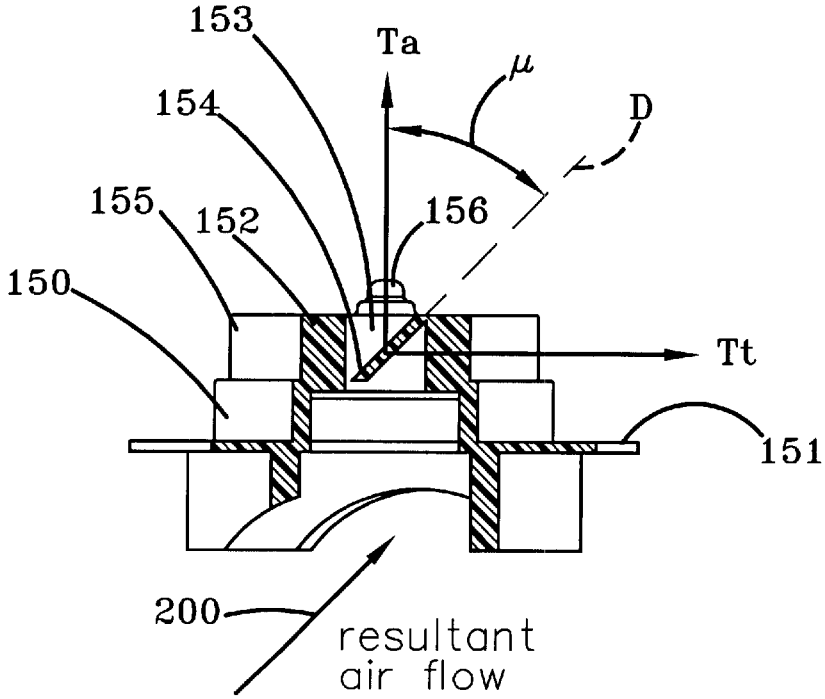
FIG. 8B is a cross-sectional view of the motor cooling fan housing shown in FIG. 8A taken along line 8B—8B of FIG. 8A showing the resultant direction of the cooling airstream relative to the plane of the vane separating adjacent vent openings.

FIG. 8A is a front view of motor cooling fan housing cover 150 comprised of a hub portion 152 and an aperture 156 in the center of hub portion 152. A plurality of vanes 154 are connected and spaced angularly about hub portion 152 and connected to hub portion 152 on their most radially inward end. The plurality of vanes 154 are connected at the opposite end to a cylindrical main body portion 155. A vent opening 153 is located between adjacent vanes 154. A lip portion 151 surrounds main body portion 155 for connecting motor cooling fan housing cover 150 to motor housing 160. A plurality of apertures 157 are formed in lip 151 for receiving screws or rivets or the like for attaching motor cooling fan housing cover 150 to motor housing 160. The plurality of vanes 154 are planar in shape and have a plane that is oriented parallel or approximately parallel to the cooling airstream flowing past the vanes 154 to minimize drag and improve cooling efficiency. This is best demonstrated in FIG. 8B wherein a cross-sectional view of motor cooling fan housing cover 150 and one of the vanes 154 is shown. The plane D cuts through vane 154 and is offset by an angle $\mu$ relative to the axial direction Ta of the motor cooling fan housing cover 150. It is desirable to have plane D parallel to the resultant direction of the airstream generated by motor cooling fan 142 which is in the direction of arrow 200. This may occur when the angle $\mu$ between plane D and the axial direction Ta of the motor cooling fan housing cover 150 is greater than 0° but less than 90°. It has been found that when angle $\mu$ is 45° the orientation of the airstream is nearly parallel to plane D and the drag created by the cooling airstream flowing past the plurality of vanes 145 is minimized. However, this is in no way meant to be limiting in that the angle $\mu$ is a matter of design choice and could vary based upon factors such as the motor cooling fan speed and size, motor cooling fan blade angle, and other factors.

Thus it can be seen that at least one or more of the objects of the invention have been satisfied by the structure presented hereinabove. While in accordance with the patent statutes, the best mode of the invention has been presented and described in detail, the invention is not limited thereto or thereby. Accordingly, for an appreciation of the true scope and breadth of the invention, reference should be made to the following claims.

What is claimed is:

1. An improved motor-fan assembly for a floor cleaning appliance, the motor-fan assembly having a motor housing having an inner chamber, a motor contained in the inner chamber, a working air cavity, a motor cooling fan for drawing a cooling airstream into the inner chamber of the motor housing to cool the motor, a working air fan for drawing dirty working air into the working air cavity, a working air fan cover attached to the motor housing to seal the working air cavity, a motor cooling fan housing cover attached to the motor housing to seal the inner chamber through which the cooling airstream exits the motor housing, the improvement comprising:

a plurality of spiral shaped grooves formed on an inner surface of said working air fan cover to reduce the noise of the working air circulating in said working air cavity adjacent to said inner surface.

2. The improved motor-fan assembly for a floor cleaning appliance of claim 1, wherein said working air fan cover includes an inlet aperture formed in the center for drawing the dirt-laden air into said working air cavity.

3. The improved motor-fan assembly for a floor cleaning appliance of claim 1, wherein said plurality of spiral shaped grooves spiral radially outward from said inlet aperture in a direction opposite to the working air fan rotational direction and extend to an outer periphery of said working air fan cover.

4. The improved motor-fan assembly for a floor cleaning appliance of claim 1 wherein, said plurality of spiral shaped grooves are 0.04 inches deep and 0.08 inches wide.

5. The improved motor-fan assembly for a floor cleaning appliance of claim 1, wherein said working air fan cover includes a channel for the dirty working air to exit said working air cavity.

6. An improved motor-fan assembly for a floor cleaning appliance, the motor-fan assembly having a motor housing having an inner chamber, a motor contained in the inner chamber, a working air cavity, a motor cooling fan for drawing a cooling airstream into the inner chamber of the motor housing to cool the motor, a working air fan for drawing dirty working air into the working air cavity, a working air fan cover attached to the motor housing to seal the working air cavity, a motor cooling fan housing cover attached to the motor housing to seal the inner chamber through which the cooling airstream exits the motor housing, the improvement comprising:

a plurality of vent openings having parallel sides in the motor cooling fan housing cover, wherein the motor cooling fan housing cover further includes:

a top plate having a geometric center, a rounded peripheral edge, and a first aperture located at said geometric center;

a cylindrical side portion connected to said top plate beneath said rounded peripheral edge;

a hub portion having a geometric center and a second aperture located at the geometric center of said hub portion and wherein said hub portion is positioned on an upper surface of said top plate such that said second aperture is positioned concentrically over said first aperture; and wherein each of said plurality of vent openings further include one rounded end defined by a circle having a center, the center of said circle being equidistant from said geometric center of said top plate, wherein the center of said circle is not collinear with said geometric center of said top plate, and wherein each of said vent openings extend from said center of said circle radially outward and terminate at the outer peripheral edge of said top plate.

7. The improved motor-fan assembly for a floor cleaning appliance of claim 6, wherein each of said plurality of vent openings have a longitudinal axis parallel to the parallel sides of said vent openings.

8. The improved motor-fan assembly for a floor cleaning appliance of claim 7, wherein said motor cooling fan housing cover has a radial axis, tangential axis, and an axial axis.

9. The improved motor-fan assembly for a floor cleaning appliance of claim 8, wherein a plane cutting through the longitudinal axis of each of said plurality of vent openings is offset from a radial line passing through the geometric center of said top plate and the center of the circles defining the rounded end of said plurality of vent openings at an angle in the range of 0° to 60°.

10. The improved motor-fan assembly for a floor cleaning appliance of claim 8, wherein a plane cutting through the longitudinal axis of each of said plurality of vent openings is offset from a radial line passing through the geometric center of said top plate and the center of the circles defining the rounded end of said plurality of vent openings at an angle of 60°.

11. An improved motor-fan assembly for a floor cleaning appliance, the motor-fan assembly having a motor housing having an inner chamber, a motor contained in the inner chamber, a working air cavity, a motor cooling fan for drawing a cooling airstream into the inner chamber of the motor housing to cool the motor, a working air fan for drawing dirty working air into the working air cavity, a working air fan cover attached to the motor housing to seal the working air cavity, a motor cooling fan housing cover attached to the motor housing to seal the inner chamber through which the cooling airstream exits the motor housing, the improvement comprising:

a plurality of vent openings and a plurality of planar shaped vanes formed in said motor cooling fan housing cover wherein adjacent vent openings are separated by one of said plurality of vanes.

12. The improved motor-fan assembly for a floor cleaning appliance of claim 11, wherein said motor cooling fan housing cover is further comprised of a hub portion having an aperture in the center and wherein said plurality of vanes are spaced angularly about said hub portion.

13. The improved motor-fan assembly for a floor cleaning appliance of claim 12, wherein said plurality of vanes are connected to said hub portion on a radially inward end and are connected at an opposite end to a cylindrical main body portion.

14. The improved motor-fan assembly for a floor cleaning appliance of claim 11 wherein each of said plurality of vanes have a plane that is offset by an angle relative to an axial direction of the motor cooling fan housing cover in range of greater than 0° but less than 90°.

15. The improved motor-fan assembly for a floor cleaning appliance of claim 11 wherein each of said plurality of vanes have a plane that is parallel to the resultant direction of the airstream generated by the motor cooling fan.

16. The improved motor-fan assembly for a floor cleaning appliance of claim 11 wherein each of said plurality of vanes have a plane that is offset by an angle relative to an axial direction of the motor cooling fan housing cover of 45°.

17. An improved motor-fan assembly for a floor cleaning appliance, the motor-fan assembly having a motor housing having an inner chamber, a motor contained in the inner chamber, a working air cavity, a motor cooling fan for drawing a cooling airstream into the inner chamber of the motor housing to cool the motor, a working air fan for drawing dirty working air into the working air cavity, a working air fan cover attached to the motor housing to seal the working air cavity, a motor cooling fan housing cover attached to the motor housing to seal the inner chamber through which the cooling airstream exits the motor housing, the improvement comprising a working air fan comprised of:

a circular shaped back plate;

a hub integrally formed with the back plate; and a plurality of curvilinear shaped fan blades integrally formed with said back plate projecting orthogonally upward from an upper surface of said back plate, said plurality of blades having a top edge and a trailing edge wherein said top edge is parallel to an inner surface of said working air fan cover.

18. An improved motor-fan assembly for a floor cleaning appliance, the motor-fan assembly having a motor housing having an inner chamber, a motor contained in the inner chamber, a working air cavity, a motor cooling fan for drawing a cooling airstream into the inner chamber of the motor housing to cool the motor, a working air fan for drawing dirty working air into the working air cavity, a working air fan cover attached to the motor housing to seal the working air cavity, a motor cooling fan housing cover attached to the motor housing to seal the inner chamber through which the cooling airstream exits the motor housing, the improvement comprising a working air fan comprised of:

a circular shaped back plate;

a hub integrally informed with the back plate; and a plurality of curvilinear shaped fan blades integrally formed with said back plate projecting orthogonally upward from an upper surface of said back plate, said plurality of blades having a top edge and a trailing edge wherein said top edge is parallel to an inner surface of said working air fan cover;

wherein said plurality of fan blades are comprised of a plurality of long fan blades and a plurality of short fan blades in an alternating arrangement extending radially from said hub.

19. The improved motor-fan assembly of claim 18 wherein said trailing edge of said plurality of fan blades of said working air fan project orthogonally upward from said back plate and are parallel to an outer circumferential wall of the working air fan cover.

20. The improved motor-fan assembly of claim 18 wherein said plurality of long fan blades extend from said hub to an outer periphery of said back plate.

21. The improved motor-fan assembly of claim 18 said plurality of short fan blades extend less than the full distance from said hub to the outer periphery of said back plate.

22. The improved motor-fan assembly of claim 18 wherein the total number of plurality of short fan blades and the plurality of long fan blades is in the range of 12 to 28 fan blades.

23. The improved motor-fan assembly of claim 18 wherein said plurality of long fan blades and said plurality of short fan blades are forward swept at the trailing edge.

24. The improved motor-fan assembly of claim 18 wherein said plurality of short fan blades have a leading edge which extends from the upper surface of said hub to the top edge of said plurality of short fan blades and slopes upwardly in the radially outward direction to aid debris in passing over said working air fan.

25. An improved motor-fan assembly for a floor cleaning appliance, the motor-fan assembly having a motor housing having an inner chamber, a motor contained in the inner chamber, a working air cavity, a motor cooling fan for drawing a cooling airstream into the inner chamber of the motor housing to cool the motor, a working air fan for drawing dirty working air into the working air cavity, a working air fan cover attached to the motor housing to seal the working air cavity, a motor cooling fan housing cover attached to the motor housing to seal the inner chamber through which the cooling airstream exits the motor housing, the improvement comprising a working air fan comprised of:

a circular shaped back plate;

a hub integrally formed with the back plate, and a plurality of curvilinear shaped fan blades integrally formed with said back plate projecting orthogonally upward from an upper surface of said back plate, said plurality of fan blades having a top edge and a trailing edge wherein said trailing edge projects orthogonally upward from said back plate and is parallel to an outer circumferential wall of the working air fan cover.

26. An improved motor-fan assembly for a floor cleaning appliance, the motor-fan assembly having a motor housing having an inner chamber, a motor contained in the inner chamber, a working air cavity, a motor cooling fan for drawing a cooling airstream into the inner chamber of the motor housing to cool the motor, a working air fan for drawing dirty working air into the working air cavity, a working air fan cover attached to the motor housing to seal the working air cavity, a motor cooling fan housing cover attached to the motor housing to seal the inner chamber through which to cooling airstream exits the motor housing, the improvement comprising a working air fan comprised of:

a circular shaped back plate;

a hub integrally formed with the back plate; and a plurality of curvilinear shaped fan blades integrally formed with said back plate projecting orthogonally upward from an upper surface of said back plate, said plurality of fan blades having a top edge and a trailing edge wherein said trailing edge projects orthogonally upward from said back plate and is parallel to an outer circumferential wall of the working air fan cover;

wherein said plurality of fan blades is comprised of a plurality of long fan blades and a plurality of short fan blades in an alternating arrangement extending radially from said hub.

27. The improved motor-fan assembly of 26 wherein said plurality of long fan blades extend from said hub to an outer periphery of said back plate.

28. The improved motor-fan assembly of claim 26 wherein said plurality of short fan blades extend less than the full distance from said hub to the outer periphery of said back plate.

29. The improved motor-fan assembly of claim 26 wherein the total number of plurality of short fan blades and the plurality of long fan blades is in the range of 12 to 28 fan blades.

30. The improved motor-fan assembly of claim 26 wherein said plurality of long fan blades and said plurality of short fan blades are forward swept at the trailing edge.

31. The improved motor-fan assembly of claim 26 wherein said plurality of short fan blades have a leading edge which extends from the upper surface of said hub to the top edge of said plurality of short fan blades and slopes upwardly in the radially outward direction to aid debris in passing over said top edge of said plurality of short fan blades.

32. An improved impeller for a floor cleaning appliance, comprised of:

a circular shaped back plate;

a hub integrally formed with the back plate, and a plurality of curvilinear shaped fan blades integrally formed with said back plate and projecting orthogonally upward from an upper surface of said back plate, said plurality of fan blades being comprised of a plurality of long fan blades and a plurality of short fan blades in an alternating arrangement extending radially from said hub;

wherein said plurality of long fan blades and said plurality of short fan blades are forward swept at a trailing edge.

33. The improved impeller of claim 32 wherein said plurality of long fan blades extend from said hub to an outer periphery of said back plate.

34. The improved impeller of claim 32 wherein said plurality of short fan blades extend less than the full distance from said hub to the outer periphery of said back plate.

35. The improved impeller of claim 32 wherein the total number of plurality of short fan blades and the plurality of long fan blades is in the range of 12 to 28 fan blades.

36. The improved impeller of claim 32 wherein said plurality of short fan blades have a leading edge which extends from the upper surface of said hub to a top edge of said plurality of short fan blades and slopes upwardly in the radially outward direction to aid debris in passing over said impeller.

* * * * *